US006888302B2

(12) United States Patent
Juestel et al.

(10) Patent No.: US 6,888,302 B2
(45) Date of Patent: May 3, 2005

(54) LOW-PRESSURE MERCURY DISCHARGE LAMP COMPRISING AN OUTER BULB

(75) Inventors: Thomas Juestel, Aachen (DE); Cornelis Reinder Ronda, Aachen (DE); Hans Nikol, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 211 days.

(21) Appl. No.: 09/864,132

(22) Filed: May 24, 2001

(65) Prior Publication Data

US 2002/0027420 A1 Mar. 7, 2002

(30) Foreign Application Priority Data

May 31, 2000 (DE) ..... 100 26 909

(51) Int. Cl.[7] ..... H01J 1/62

(52) U.S. Cl. ..... 313/489; 313/573; 313/25; 313/635; 313/485

(58) Field of Search ..... 313/17, 483–487, 313/489, 25, 514, 572, 573, 26; 252/301.4 S, 301.4 F, 301.6 S, 301.6 F, 301.6 R, 301.4 BF

(56) References Cited

U.S. PATENT DOCUMENTS 4,508,993 A * 4/1985 Anderson ..... 315/59
4,599,536 A * 7/1986 Steeger et al. ..... 313/493
5,041,762 A * 8/1991 Hartai ..... 315/169.3
5,105,122 A * 4/1992 Konings et al. ..... 313/487
5,744,233 A * 4/1998 Opitz et al. ..... 428/328
5,760,542 A * 6/1998 Bechtel et al. ..... 313/491
5,804,914 A 9/1998 Ozawa et al.
5,828,170 A * 10/1998 Nishio et al. ..... 313/493
5,959,405 A * 9/1999 Soules et al. ..... 313/635
6,404,122 B1 * 6/2002 Lankhorst et al. ..... 313/490
6,437,502 B1 * 8/2002 Nishio et al. ..... 313/493

FOREIGN PATENT DOCUMENTS

DE 19737920 A 3/1999 ..... H01J/61/43

* cited by examiner

*Primary Examiner*—Ashok Patel
(74) *Attorney, Agent, or Firm*—Ernestine C. Bartlett

(57) ABSTRACT

A low-pressure mercury discharge lamp comprising an inner bulb, which forms a gas discharge vessel and the wall of which is made of a material which is transparent to electromagnetic radiation and is coated with a phosphor, and comprising an outer bulb surrounding the inner bulb, the wall of which contains an UV-A phosphor, and comprising means for generating and maintaining a low-pressure mercury gas discharge.

9 Claims, 1 Drawing Sheet

LOW-PRESSURE MERCURY DISCHARGE LAMP COMPRISING AN OUTER BULB

Figure 1:
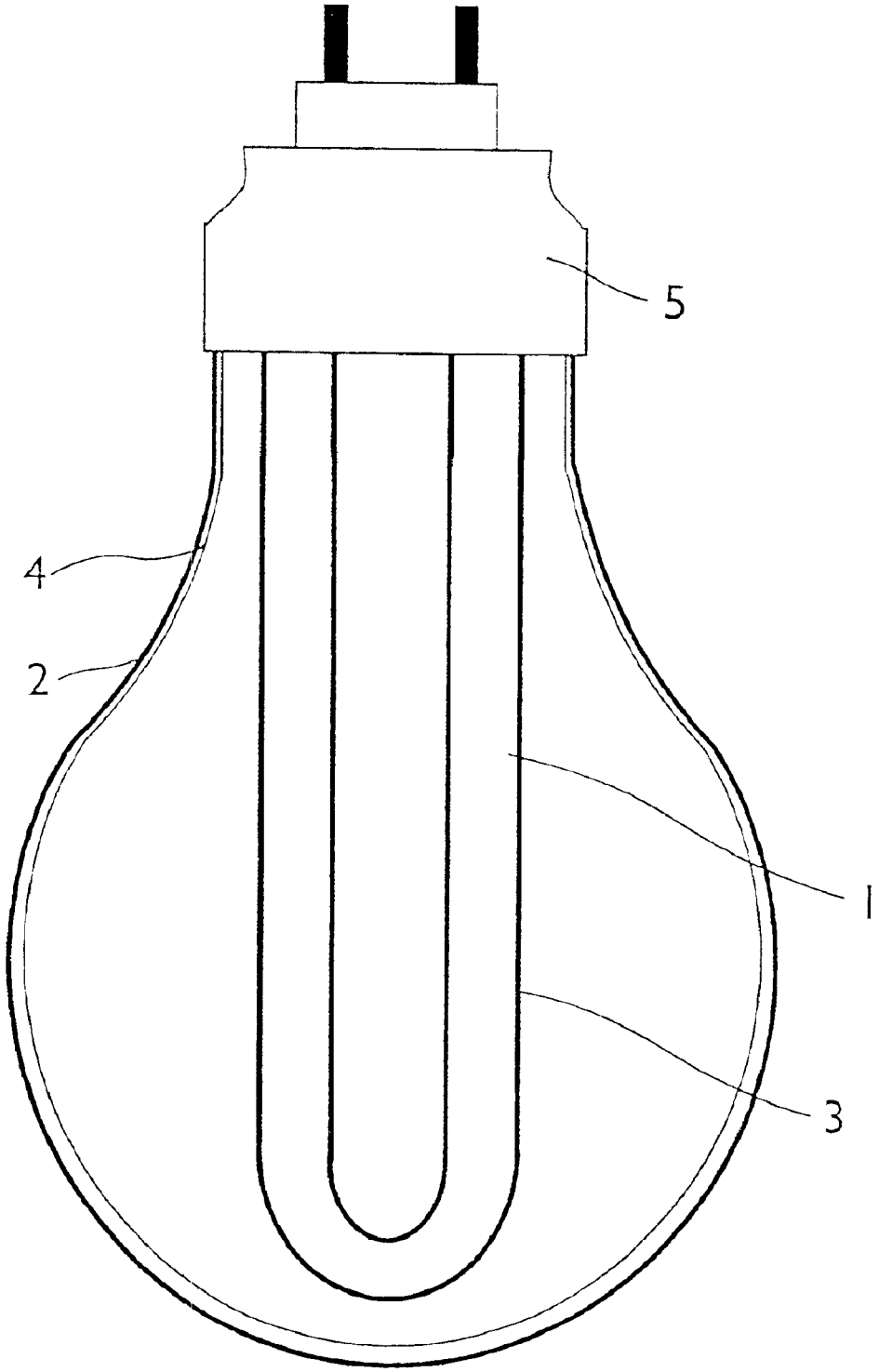

The invention relates to a low-pressure mercury discharge lamp, in particular a compact fluorescent lamp, comprising an inner bulb, which forms a gas discharge vessel and the wall of which is made of a material which is transparent to electromagnetic radiation and is coated with a phosphor, and comprising an outer bulb, which surrounds the inner bulb, and the wall of which contains a phosphor, and comprising means for generating and maintaining a low-pressure mercury discharge.

A conventional compact fluorescent lamp customarily comprises a thin single or multiple-bent tubular gas discharge vessel at the ends of which inner electrodes, for example coils of tungsten, are situated. Apart from an inert gas filling, the discharge vessel contains a small quantity of mercury, and is mounted, in conjunction with the ballast and the starter, onto a cap. In the gas discharge vessel, a low-pressure mercury gas discharge generates UV radiation, which is converted into visible light by means of one or more UV phosphors with which the inner surface of the gas discharge vessel is coated.

The glass type used for the gas discharge vessel is generally chosen so as to be suitable for mass-production with short processing times. These glass types are transparent to visible light and UV-A light with a wavelength up to 300 nm, and non-transparent to UV light with a wavelength <300 nm.

In order to protect the thin gas discharge vessel against damage, an enveloping, protective outer bulb can be provided. Preferably, the appearance of this outer bulb corresponds to that of conventional pear-shaped incandescent lamps, so that the appearance of lamps to which the user is accustomed is preserved.

DE 197 37 920 A1 discloses a low-pressure gas discharge lamp, wherein the discharge vessel forms an inner bulb which is transparent to electromagnetic radiation, which inner bulb is surrounded by an outer bulb, the outside of the inner bulb and/or the inside of the outer bulb being provided with a phosphor layer, and the inner bulb comprising mercury vapor and/or metal vapor-generating compounds and/or inert gases, and said inner bulb being transparent to electromagnetic radiation generated when the relevant gases are excited to become fluorescent. In particular, these inner bulbs are made of quartz or of special glass types which are transparent to UV light.

It is an object of the invention to provide, inter alia, a low-cost fluorescent lamp comprising an outer bulb, which lamp has an improved light output.

In accordance with the invention, this object is achieved by a low-pressure mercury gas discharge lamp comprising an inner bulb, which forms a gas discharge vessel and the wall of which is made of a material which is transparent to electromagnetic radiation and is coated with a phosphor, and comprising an outer bulb surrounding the inner bulb, the wall of which contains an UV-A phosphor, and comprising means for generating and maintaining a low-pressure mercury gas discharge.

Such a low-pressure mercury gas discharge lamp can be made from low-cost glass types. In spite of absorption losses in the UV-A phosphor layer, the light output of these gas discharge lamps is improved in the high eye-sensitivity range as, in addition, UV-A radiation is converted to visible light.

It is particularly advantageous that the low-pressure mercury discharge lamp in accordance with the invention does not emit UV-A radiation. The deleterious, photoionizing effect of this radiation on the human skin, colors, synthetic resins and rubber products is thus avoided. As a result, the low-pressure mercury discharge lamps in accordance with the invention are particularly suitable for the illumination of offices, museums and laboratories.

In accordance with an embodiment of the invention, the wall of the outer bulb may comprise a coating containing the UV-A phosphor.

In accordance with another embodiment, the wall of the outer bulb is made of a material containing a polymeric synthetic resin and the UV-A phosphor. This embodiment, wherein the UV-A phosphor is embedded in the polymeric synthetic resin, is particularly suitable for hydrolysis-sensitive phosphors.

Preferably, the UV-A phosphor is selected from the group formed by ZnS:Ag, $YVO_4$:Eu, $Y(V,P)O_4$:Eu, $Y_2O_2S$:Eu, $CaSiO_3$:Ce,Mn, $CaSO_4$:Ce,Mn, $Y_2SiO_5$:Ce,Mn, $BaMgAl_{10}O_{17}$:Eu,Mn and $(Ba,Sr,Ca)_5(PO_4)_3Cl$:Eu,Mn. These UV-A phosphors are characterized by a high reflectance in the visible region from 400 to 780 nm.

It may alternatively be preferred that the UV-A phosphor is selected from the group formed by ZnS:Cu,Au; CaS:Eu; $SrGa_2S_4$:Eu, and $Mg_4GeO_{5.5}F$:Mn. The body color of these UV-A phosphors is such that these phosphors can additionally be used for decorative purposes.

Within the scope of the invention, it is particularly preferred for the inner bulb to be tubular and bent, or tubular and coiled, so that said inner bulb can be enveloped by a pear-shaped outer bulb.

These and other aspects of the invention will be apparent from and elucidated with reference to the embodiment(s) described hereinafter.

In the drawing:

FIG. 1 is a diagrammatic, cross-sectional view of a low-pressure mercury discharge lamp in accordance with the invention.

In this embodiment, the discharge lamp comprises an inner bulb 1 forming the gas discharge vessel for the low-pressure mercury gas discharge. Electrodes are sealed-in at both ends of the inner bulb, enabling the gas discharge to be ignited. The inner bulb is filled with mercury vapor at a pressure of several hundredths of a Torr as well as with argon.

The wall of the inner bulb is made of a material which is transparent to UV-A radiation with a wavelength ranging between 320 and 400 nm, and is coated, on the inside, with a phosphor layer.

In the embodiment in accordance with the invention shown in FIG. 1, the inner bulb 1 is tubular and bent so as to be U-shaped, and said inner bulb is enveloped by a pear-shaped outer bulb 2.

The low-pressure mercury discharge lamp additionally comprises means for generating and maintaining a low-pressure mercury gas discharge, such as a choke and a starter.

In accordance with a different embodiment according to the invention, the inner bulb may alternatively be a multiple-bent or coiled tube.

As regards the outer bulb, any shape known from incandescent lamps can be chosen, for example, ball-shaped, cherry-shaped or droplet-shaped.

In accordance with yet another embodiment according to the invention, inner bulbs and outer bulbs are rod, ring or U-shaped coaxial tubes.

For the inner bulb use is preferably made of a glass type that is customarily used for the manufacture of incandescent lamps and fluorescent tubes, for example a sodium lime-silicate glass having a $SiO_2$ content in the range from 69 to 73%, an $Al_2O_3$ content in the range from 1 to 2%, a MgO content in the range from 3 to 4%, a $Na_2O$ content in the range from 15 to 17%, a CaO content in the range from 4.2 to 4.6%, a BaO content in the range from 0.1 to 2%, and a $K_2O$ content in the range from 0.4 to 1.6%. Other glass types allowing passage of UV-A radiation up to 300 nm may alternatively be used as the bulb material for the inner bulb.

The inner wall of the inner bulb is coated with one or more UV phosphors, which absorb the UV light generated by the low-pressure mercury gas discharge and convert it into visible light. Each phosphor has its own characteristic absorption and emission spectrum. During the mercury low-pressure discharge, by far the largest part of the energy is emitted in the resonance lines at 185.0 and 253.7 nm, therefore, also the absorption coefficient of the phosphor for the inner bulb must be high in this range. Therefore, the phosphor used for the inner bulb preferably is made of calciumhalogenphosphate $Ca_5(PO_4)_3(F,Cl):Sb^{3+},Mn^{2+}$, an aluminate phosphor, for example europium-activated barium-magnesium-aluminate $Ba(Al,Mg)_{11}O_{19}:Eu^{2+}$ and terbium-activated Cer-magnesium-aluminate $CeMgAl_{11}O_{19}$:Gd,Tb or $LaPO_4$:Ce,Tb in combination with $Y_2O_3$:Eu as a three-band phosphor mixture.

The optimum thickness of the phosphor layer on the inner bulb ranges from approximately 30 to 50 nm. The reason for this being that, on the one hand, said layer should only be so thin that still enough UV radiation is absorbed while, on the other hand, said layer should only be so thick that not too much visible radiation formed in the inner grains of the phosphor layer is absorbed. For this reason, the phosphor layer on the inner bulb must not be applied in such a thickness that all UV radiation is absorbed. Glass used for lamps is transparent to UV-A radiation, as are the customarily used glass types, so that this radiation can leave the inner bulb.

Also the outer bulb can be manufactured from a customary type of lamp glass. If the outer bulb is made of glass, the UV-A phosphor is preferably provided in the form of a coating.

In accordance with another embodiment according to the invention, the wall of the outer bulb is made of a material comprising a polymeric synthetic resin and a UV-A phosphor. Particularly suitable polymeric synthetic resins are polymethylmethacrylate (PMMA), polyethyleneterephtalate (THV), fluoroethylenepropylene (FEP) or polyvinyldifluoride (PVDF).

The UV-A phosphor used for the outer bulb is a phosphor whose absorption maximum in the UV-A range lies between 320 and 400 nm, and which emits in the visible region. Suitable UV-A phosphors are, for example, phosphors which, apart from an activator, comprise a sensitizer, which absorbs the UV-A radiation and transfers it to the activator. Suitable sensitizers for Mn(II)-containing phosphors are Ce(III) ions and Eu(II) ions, such as in $CaSiO_3$:Ce,Mn, $CaSO_4$:Ce,Mn, $Y_2SiO_5$:Ce,Mn, $BaMgAl_{10}O_{17}$:Eu,Mn and $(Ba,Sr,Ca)_5(PO_4)_3Cl$:Eu,Mn.

Eu(III)-containing phosphors may comprise vanadate ions $VO_4^{3-}$ as the sensitizer, as in the case of, for example, the phosphors $YVO_4$:Eu and $Y(V,P)O_4$:Eu.

Other suitable UV-A phosphors comprise host lattices with a narrow bandgap having a bandwidth between 3.0 and 4.0 eV. In the light-emission process, the host lattice absorbs the UV-A radiation and transfers it to the activator. Examples of this type of UV-A phosphors are ZnS:Ag and $Y_2O_2S$:Eu.

It is also possible to employ UV-A phosphors with a body color, such as the yellow phosphors ZnS:Cu,Au; $SrGa_2S_4$:Eu and $Mg_4GeO_{5.5}F$:Mn and red CaS:Eu. In this manner, lamps are achieved which, in the ignited state, have the same appearance as conventional, white incandescent lamps, but which have a colored appearance in the off-state.

These UV-A phosphors can be manufactured in an optimum grain size distribution with an average grain size of 0.5 to 1 $\mu$m. Said grain size is determined by the properties of the phosphor, i.e. whether said phosphor absorbs UV radiation and absorbs as well as scatters visible radiation, but also by the necessity of forming a phosphor coating that firmly adheres to the glass wall. The latter requirement is met only by very small grains whose light output is smaller than that of slightly larger grains.

For an outer bulb of a polymeric synthetic resin, which comprises the UV-A phosphor, the phosphor powder is preferably mixed with synthetic resin pellets and subsequently extruded and rolled so as to form a foil. This foil can subsequently be formed into an outer bulb.

If the UV-A phosphor is to be applied to the outer bulb in the form of a coating, use can be made of dry-coating methods, such as electrostatic deposition or electrostatically assisted powdering, as well as wet-coating methods, such as dip coating or spraying.

In the case of a wet-coating method, the phosphors must be dispersed in water, an organic solvent, if necessary in conjunction with a dispersing agent, a surface-active agent and an anti-foaming agent, or a binder preparation. Suitable binder preparations for a lamp in accordance with the invention are organic or inorganic binders which are capable of withstanding operating temperatures of 250° C. without being subject to decomposition, embrittlement or discoloration.

For the solvent for the phosphor preparation use is preferably made of water to which a thickening agent such as polymethacrylic acid or polypropylene oxide is added. Customarily, use is made of further additives, such as dispersing agents, defoaming agents and powder conditioning agents, such as aluminum oxide, aluminum oxynitride or boric acid. The phosphor preparation is either poured, rinsed or sprayed onto the inner side of the outer bulb. The coating is subsequently dried by means of hot air. The thickness of the coatings generally ranges from 1 to 50 $\mu$m.

When the lamp is ignited, the electrons emitted by the electrodes excite the mercury atoms of the gas filling so as to emit UV radiation of the above mentioned wavelength and visible radiation. Said UV radiation is incident on the phosphor coating of the inner bulb and causes this phosphor coating to emit visible radiation and UV-A radiation. The visible radiation is allowed to pass the outer bulb without hindrance. The UV-A radiation leaving the inner bulb excites the UV-A phosphor in the outer bulb, thereby causing the outer bulb to emit additional visible light.

EXAMPLE 1

To manufacture the outer bulb coating, a dispersion of 15.0% by weight $Y_2SO_5$:Ce,Mn, 0.75% by weight sodium polyacrylate as the dispersing agent and 0.075% by weight polyethylenepropylene oxide as the anti-foaming agent are subjected to a wet-grinding process with water in an agitating mill to disperse the agglomerated phosphor. The purified and baked-out lamp bulbs are immersed in this dispersion and subsequently burned in at 480° C. The applied quantity of phosphor is 5.0 g. The coated outer bulb is mounted in conjunction with the inner bulb, the ballast and the starter onto a common cap in a customary manner.

EXAMPLE 2

A quantity of 3.5 g $Y_2O_2S$:Eu and 25 g polyethyleneterephtalate are dissolved in 100 g of an acetone/toluol mixture. A quantity of 10 g of this solution is sprayed onto the inner side of a lamp bulb. Subsequently, the coating is dried in an air flow. The coated outer bulb is mounted in conjunction with the inner bulb, the ballast and the starter onto a common cap in a customary manner.

EXAMPLE 3

A mixture of 90 parts of polymethylmethacrylate pellets is mixed with 10 parts of CaS:Eu and extruded into a film at 295° C., which is subsequently formed into a pear-shaped bulb. The outer bulb is mounted in conjunction with the inner bulb, the ballast and the starter onto a common cap in a customary manner.

What is claimed is:

1. A low-pressure mercury gas discharge lamp comprising an inner bulb, which forms a gas discharge vessel and the wall of which is made of a material which is transparent to electromagnetic radiation and is coated with a phosphor, and comprising an outer bulb surrounding and spaced apart from the inner bulb, the wall of which contains an UV-A phosphor, and comprising means for generating and maintaining a low-pressure mercury gas discharge.

2. A low-pressure mercury gas discharge lamp as claimed in claim 1, characterized in that the wall of the outer bulb comprises a coating containing the UV-A phosphor.

3. A low-pressure mercury gas discharge lamp as claimed in claim 1, characterized in that the wall of the outer bulb is made of a material containing a polymeric synthetic resin and the UV-A phosphor.

4. A low-pressure mercury gas discharge lamp as claimed in claim 1, characterized in that the UV-A phosphor is selected from the group formed by ZnS:Ag, $YVO_4$:Eu, $Y(V,P)O_4$:Eu, $Y_2O_2S$:Eu, $CaSiO_3$:Ce,Mn, $CaSO_4$:Ce,Mn, $Y_2SiO_5$:Ce,Mn, $BaMgAl_{10}O_{17}$:Eu,Mn and $(Ba,Sr,Ca)_5(PO_4)_3Cl$:Eu,Mn.

5. A low-pressure mercury gas discharge lamp as claimed in claim 1, characterized in that the UV-A phosphor is selected from the group formed by ZnS:Cu,Au; CaS:Eu; $SrGa_2S_4$:Eu, and $Mg_4GeO_{5.5}F$:Mn.

6. A low-pressure mercury gas discharge lamp as claimed in claim 1, characterized in that the inner bulb is tubular and bent.

7. A low-pressure mercury gas discharge lamp as claimed in claim 1, characterized in that the inner bulb is tubular and coiled.

8. A low-pressure mercury gas discharge lamp as claimed in claim 6, characterized in that the outer bulb is pear-shaped.

9. A low-pressure mercury gas discharge lamp as claimed in claim 7, characterized in that the outer bulb is pear-shaped.

* * * * *